US012601259B2

(12) United States Patent
Bahr et al.

(10) Patent No.: US 12,601,259 B2
(45) Date of Patent: Apr. 14, 2026

(54) REBUILDABLE HARD SURFACE CUTTING TIP FOR MINING BIT

(71) Applicant: Bit Service Company LTD, Saskatoon (CA)

(72) Inventors: Scott Bahr, Sasksatoon (CA); Ian Cheshuk, Sasksatoon (CA)

(73) Assignee: Bit Service Company LTD, Saskatoon (CA)

( * ) Notice: Subject to any disclaimer, the term of this patent is extended or adjusted under 35 U.S.C. 154(b) by 180 days.

(21) Appl. No.: 18/406,714

(22) PCT Filed: Jul. 15, 2021

(86) PCT No.: PCT/CA2021/050983
§ 371 (c)(1),
(2) Date: Jan. 8, 2024

(87) PCT Pub. No.: WO2023/283718
PCT Pub. Date: Jan. 19, 2023

(65) Prior Publication Data

US 2025/0122803 A1 Apr. 17, 2025

(51) Int. Cl.
*E21C 35/183* (2006.01)

(52) U.S. Cl.
CPC ..... *E21C 35/1835* (2020.05); *E21C 35/183* (2013.01); *E21C 35/1837* (2020.05)

(58) Field of Classification Search
CPC . E21C 35/183; E21C 35/1835; E21C 35/1837
See application file for complete search history.

(56) References Cited

U.S. PATENT DOCUMENTS 1,927,818 A * 9/1933 Brodersen ..... E02F 9/285 172/745
2,645,471 A * 7/1953 King ..... E21C 35/183 D15/139
2,916,275 A * 12/1959 Bruestle ..... E21C 35/19 299/109
3,057,609 A * 10/1962 Krekeler ..... E21C 35/19 408/239 R
3,246,930 A * 4/1966 Krekeler ..... E21C 35/1936 37/459
6,478,383 B1 * 11/2002 Ojanen ..... E21C 35/197 299/111
2003/0230926 A1 * 12/2003 Mondy ..... E21C 35/183 299/110

* cited by examiner

*Primary Examiner* — Janine M Kreck
(74) *Attorney, Agent, or Firm* — Spencer Fane, LLP

(57) ABSTRACT

A replaceable bit for use in radial mining equipment and methods for manufacturing and rebuilding the bit, the bit having a body, the body having a retention portion and an ore face engagement portion, the ore face engagement portion having an ore-facing surface, where the ore-facing surface is provided with hard surfacing.

9 Claims, 6 Drawing Sheets

REBUILDABLE HARD SURFACE CUTTING TIP FOR MINING BIT

REFERENCE TO RELATED APPLICATIONS

This application claims priority to PCT/CA2021/050983, which was filed on Jul. 15, 2021, the contents of which are incorporated herein by reference.

TECHNICAL FIELD OF THE INVENTION

The present invention relates to mining bits used in shearing mined surfaces, and more particularly to bit cutting surface designs and methods of manufacture.

BACKGROUND OF THE INVENTION

It is known in the art of subsurface natural resource mining operations to employ various types of equipment designed to extract ore from a mining face. For example, in some mining operations rotary members engage a potash ore face to scrape ore off of the face for subsequent removal to processing facilities. Such rotary members are commonly provided with a plurality of bits of various designs, which bits are provided with cutting surfaces, edges or points to perform the scraping as the rotary members rotate adjacent the ore face.

In some mining operations, replaceable bits have been designed and implemented wherein a cutting surface is provided with a tungsten carbide tip. Looking to FIG. 1, a conventional tungsten carbide-tipped bit 1 is illustrated. In this conventional design, the bit 1 comprises a body or forging 2 which is provided with a mating area for receipt of a tungsten carbide insert 3.

The insert 3 is held in place in the mating area by means of a brazing or braze joint 4, and the insert 3 has a tapered cutting face 5 for engaging the ore face.

While the hardness of a tungsten carbide tip is viewed as advantageous in terms of providing an effective cutting surface, with these inserts being widely used, it has been found that carbide-equipped radial bits have relatively high failure rates due to braze failure and subsequent loss of the inserts. Variable rates of thermal expansion between the forging and the insert appear to be a significant contributor to cracking of the insert and failure. Also, while inserts can be replaced and such replacement is based on economic feasibility, in some cases the forged steel body has worn down in the mating area which compromises the brazing area and thus the ability to secure the replacement insert. Material could be added to restore the gage length and machining employed to then restore the insert mounting location, but this combined process renders the restoration uneconomical.

Further, conventional bits like that illustrated in FIG. 1 employ a tapered cutting surface, and it has been found that in some circumstances a tapered cutting surface generates a fracturing action due to its undesirable cutting mechanism.

Prior art development has focused on improved braze joints and modifications to the cutting surface profile, but what is needed is a bit design that provides a robust and more readily rebuildable bit for use in mining operations.

SUMMARY OF THE INVENTION

According to a first broad aspect of the present invention, there is provided a replaceable bit for use in radial mining equipment, the bit comprising:

a body, the body comprising a retention portion and an ore face engagement portion, the ore face engagement portion having an ore-facing surface; and the ore-facing surface is provided with hard surfacing.

In some exemplary embodiments of the first broad aspect of the present invention, the body is composed of AISI 4140 steel. The ore face engagement portion preferably comprises an integral removal notch and the retention portion preferably comprises an integral retention notch.

The hard surfacing is preferably composed of a powdered compound with a nickel base. Further, in preferred embodiments the hard surfacing is provided with a flat cutting profile generally parallel to the ore-facing surface. The hard surfacing is preferably of a uniform thickness in the range of 0.03 inches to 0.1 inches, and most preferably a uniform thickness of 0.0625 inches.

In some exemplary embodiments, the body and the hard surfacing are composed of materials having similar thermal expansion rates. The ore face engagement portion is preferably provided with a dual angle back cut adjacent the ore-facing surface and the hard surfacing.

According to a second broad aspect of the present invention, there is provided a method for manufacturing a bit for use in radial mining equipment, the method comprising the steps of:

a. providing steel;
b. forging the steel into a bit body;
c. through hardening the bit body;
d. applying hard surfacing to a cutting tip of the bit body; and
e. shaping the hard surfacing to form a cutting surface.

In some exemplary embodiments of the second broad aspect of the present invention, the steel is AISI 4140 steel. The forging of the steel is preferably closed die hammer forging. The bit body is preferably through hardened to 45-50 RC, and most preferably to 46-48 RC.

In some exemplary methods, there is a step of shot blasting and cleaning after step c. but before step d. Exemplary methods may further comprise the step after step c. and before step d. of removing approximately 0.030 inches from the cutting tip to allow for the application in step d. of the hard surfacing and the shaping of step e. to form the cutting surface with a thickness of the hard surfacing of 0.0625 inches. The step of shaping the hard surfacing preferably comprises grinding the hard surfacing to a desired profile to form a profiled surfacing and then sharpening the profiled surfacing.

According to a third broad aspect of the present invention, there is provided a method for rebuilding a bit for use in radial mining equipment, the bit comprising an ore face engagement portion, the ore face engagement portion having an ore-facing surface provided with hard surfacing wherein at least a portion of the hard surfacing has worn away, the method comprising the steps of:

a. where the ore face engagement portion has partially worn away, adding material to the ore face engagement portion to restore gage length and forming the ore-facing surface;
b. applying new hard surfacing to the ore-facing surface;
c. profiling the new hard surfacing to form a profiled surfacing; and
d. sharpening the profiled surfacing to form a cutting surface.

In some exemplary embodiments of the third broad aspect of the present invention the material is AISI 4140 steel and the material is added using a plasma transfer arc process.

Preferably, the new hard surfacing is composed of a powdered compound with a nickel base.

A detailed description of exemplary embodiments of the present invention is given in the following. It is to be understood, however, that the invention is not to be construed as being limited to these embodiments. The exemplary embodiments are directed to particular applications of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention.

Exemplary embodiments will now be described with reference to the accompanying drawings.

DETAILED DESCRIPTION OF EXEMPLARY EMBODIMENTS

Throughout the following description, specific details are set forth in order to provide a more thorough understanding to persons skilled in the art. However, well known elements may not have been shown or described in detail to avoid unnecessarily obscuring the disclosure. The following description of examples of the invention is not intended to be exhaustive or to limit the invention to the precise form of any exemplary embodiment. Accordingly, the description and drawings are to be regarded in an illustrative, rather than a restrictive, sense.

The present invention is directed to a replaceable bit, and methods of manufacturing and rebuilding same. Unlike some conventional bit designs which incorporate inserts of desirable hardness but issues with failure at brazing joints, embodiments of the present invention involve forging steel to form a bit body and then applying hard surfacing to the tip of the bit. The hard surfacing is preferably formed into a desirable profile and then sharpened to form the cutting edge, as set forth below.

Figure 2:
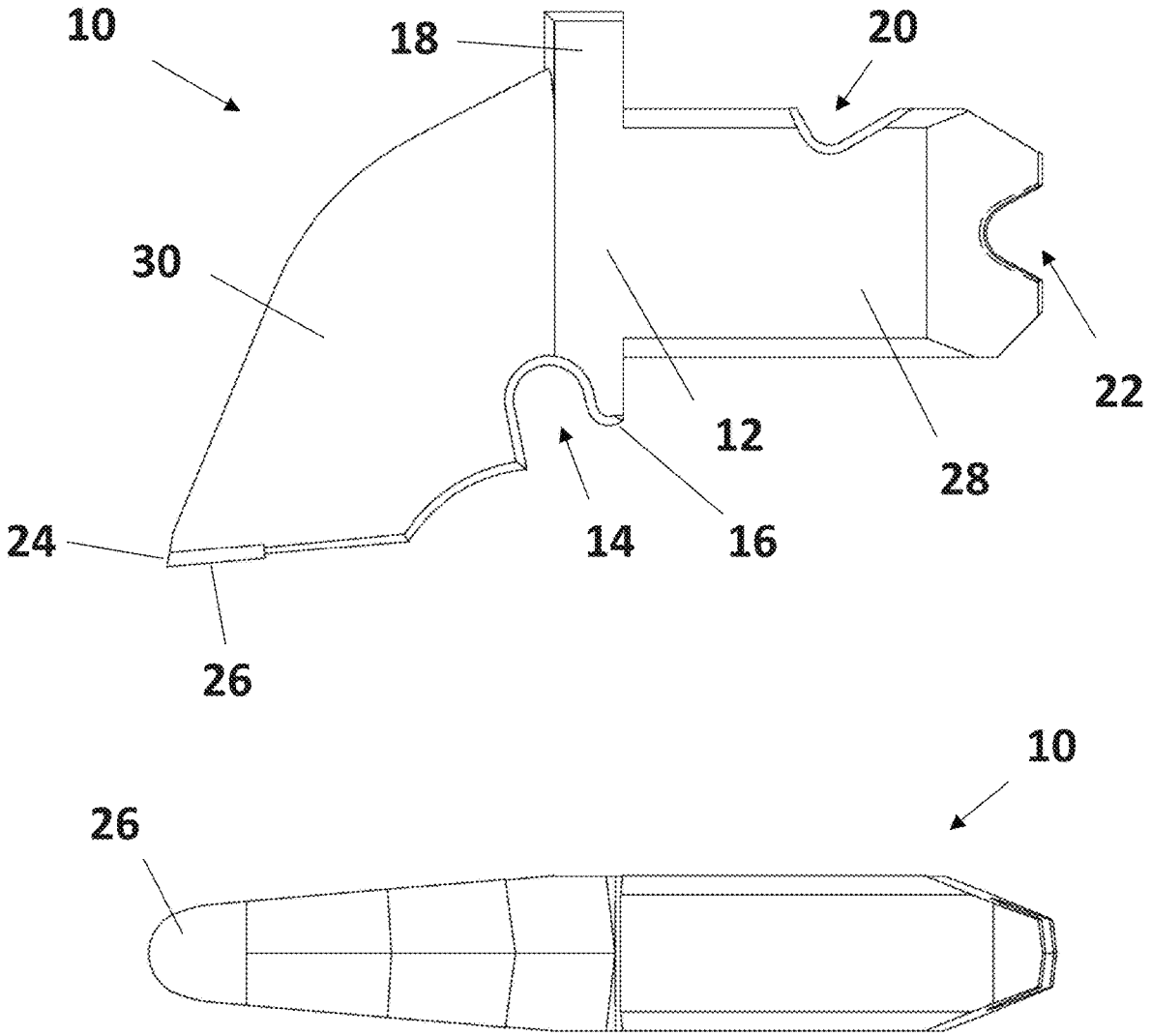
FIG. 2 is an embodiment of the present invention in side elevation and bottom plan views.
Figure 3:
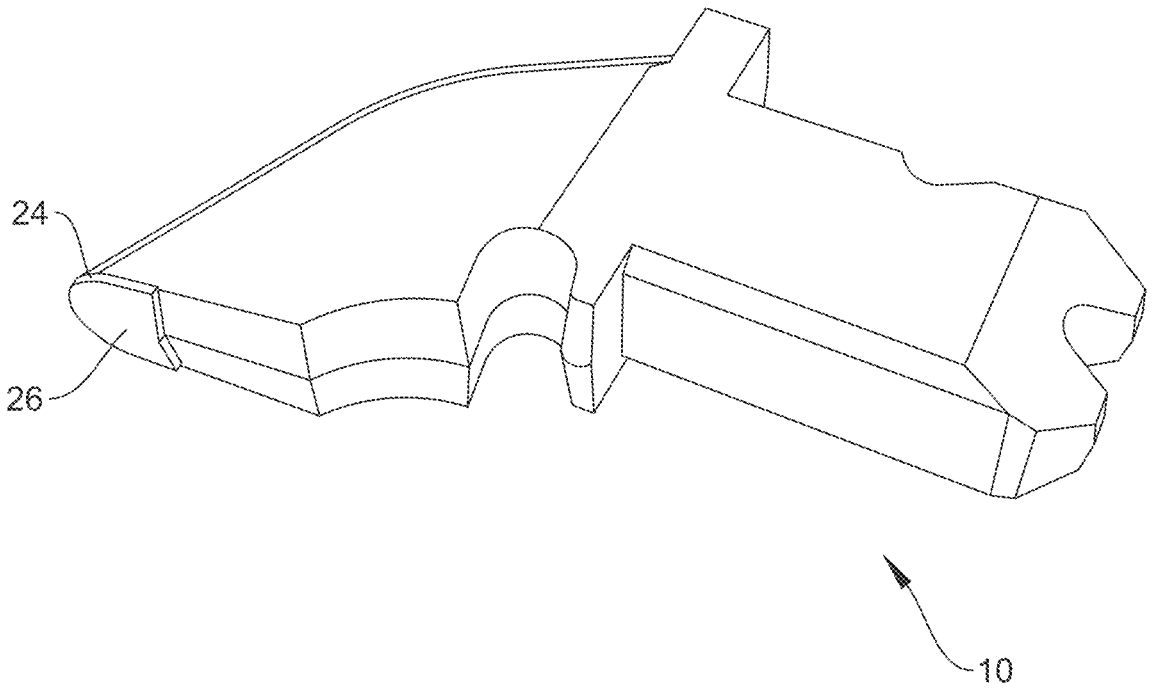
FIG. 3 is a perspective view of the embodiment of FIG. 2.

Turning now to FIGS. 2 and 3, an exemplary bit 10 is illustrated in accordance with one embodiment of the present invention. The bit 10 is unitary in manufacture, other than the hard surfacing which is applied as described below. The bit 10 comprises a body or forging 12, which may be composed of any suitable material known to those skilled in the art in the context of use of the bit 10 in mining applications, but in the exemplary embodiment the body 12 is formed from AISI 4140 steel using closed die hammer forging. The body 12 is preferably through hardened to 45-50 RC, and most preferably to 46-48 RC, as hardnesses below this range may produce a bit that is too soft while hardnesses above this range may introduce undesirable brittleness, although those skilled in the art would appreciate that this range may be modified as appropriate in different settings or using different materials.

Figure 4:
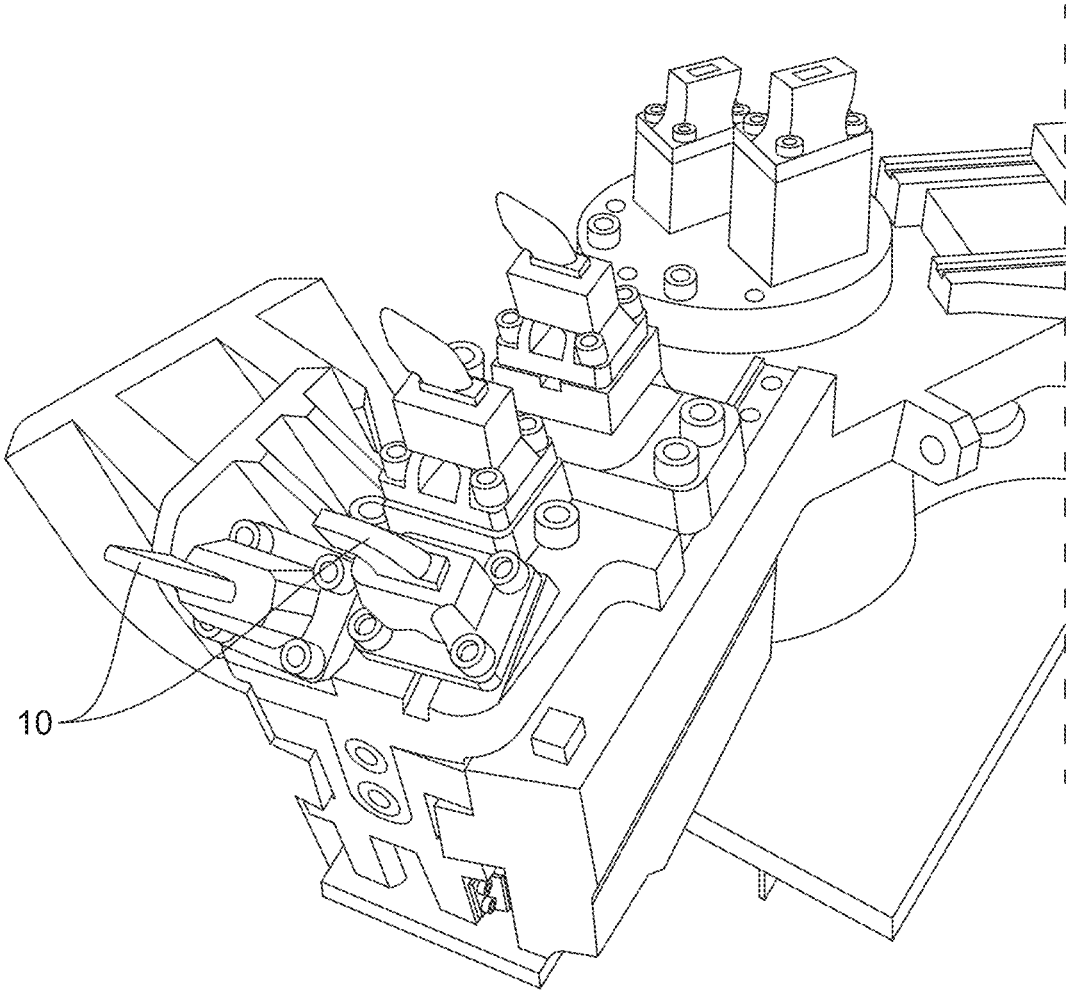
FIG. 4 is a photograph of bits according to FIGS. 2 and 3 installed in a rotor.
Figure 5:
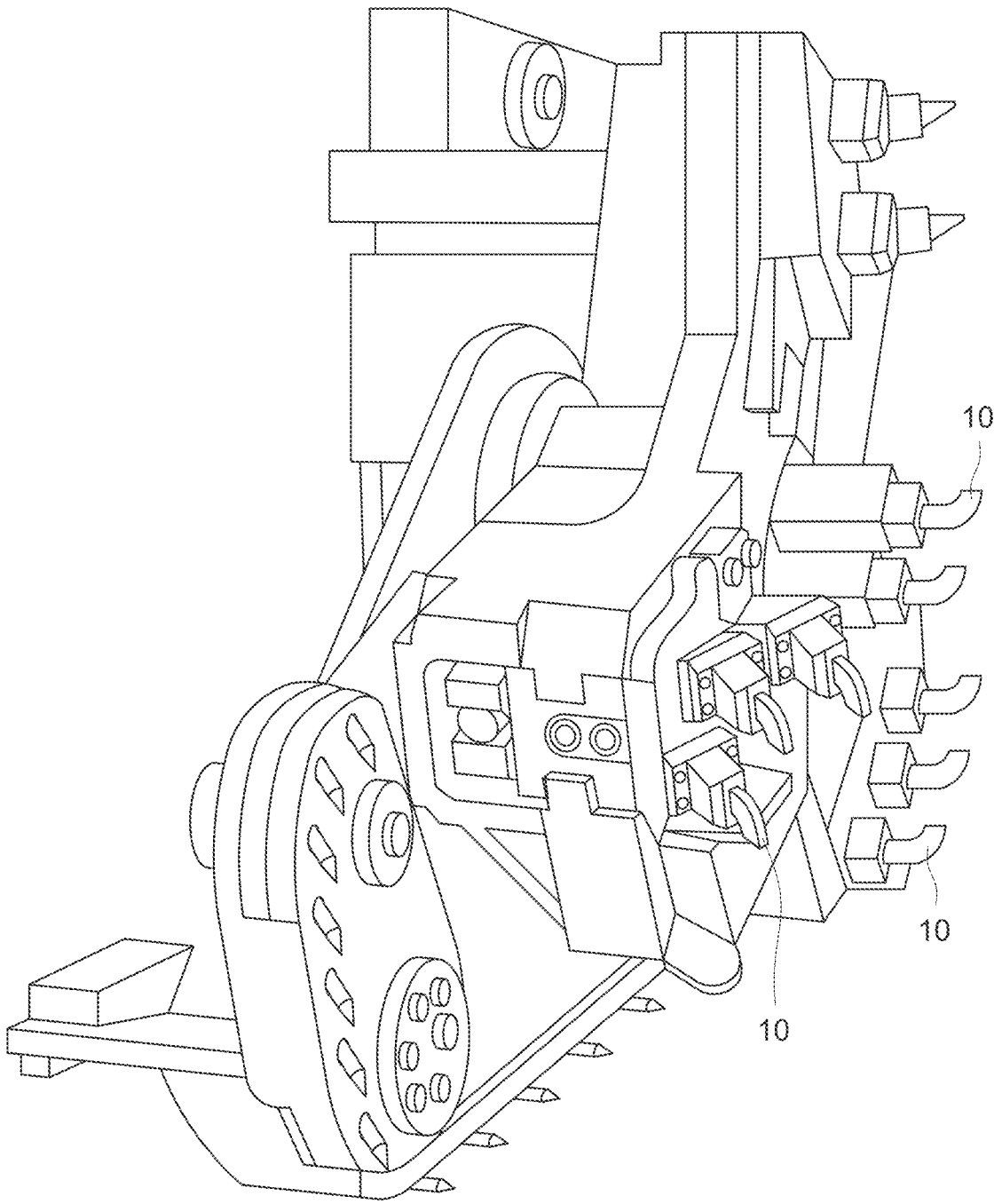
FIG. 5 is a photograph of bits according to FIGS. 2 and 3 installed in a boring machine.

The body 12 when formed can generally be viewed as comprising two discrete functional portions, a retention portion 28 and an ore face engagement portion 30. The retention portion 28 is used to retain the bit 10 in engagement with the particular mining equipment, such as is shown in FIG. 4 and FIG. 5. The retention portion 28 comprises a retention notch 20 for use in conventionally securing the bit 10 in the mining equipment. The retention portion 28 further comprises an extended toe 16 and an extended heel 18, to help seat and secure the bit 10 in position for use in engaging the ore face.

The retention portion 28, in addition to features used in securing the bit 10 in place, includes other features useful for removing the bit 10 should it need to be changed out or repaired. In the illustrated example, the retention portion 28 accordingly includes a removal notch 22 and a bit removal groove or puller 14, which are used in a conventional manner to extract the bit 10 from the equipment when desired.

The bit 10 further comprises a second functional portion, the ore face engagement portion 30, which is directed toward engagement with the ore face for extraction of ore therefrom. The ore face engagement portion 30 comprises the working end or tip of the bit 10, which in the present invention comprises a hardened cutting surface 24 applied to an ore-facing surface of the ore face engagement portion 30.

While various hard surfacing materials could be selected by the skilled person depending on the specific application, in the exemplary embodiment the hard surfacing is composed of a powdered compound with a nickel base. By using a nickel base for the hard surfacing, it is believed that the hardened cutting surface 24 will be better able to resist corrosion-induced thermal cracking that is present in some prior art bits. The hard surfacing may comprise powdered tungsten carbide particles in a nickel matrix, ranging from 50% tungsten carbide to a 50% nickel base by volume to 70% tungsten carbide to a 30% nickel base by volume, but most preferably around 60% tungsten carbide to a 40% nickel base by volume. The carbide is derived cast and crushed from a microhardness of 2400 HV (50-100 g load $kg/mm^2$). The hard surfacing is preferably applied at an initial thickness of around 0.09375 inches, with final finishing reducing that to a uniform thickness of between 0.03 inches and 0.1 inches, and preferably around 0.0625 inches, providing wear resistance while resisting delamination, as a thickness below this range might wear too quickly while a thickness above this range might be susceptible to delamination. As the body 12 and hardened cutting surface 24 are composed of materials that are more similar in terms of thermal expansion rates than is the case with conventional tungsten carbide insert bits, this aids in reducing thermal-induced cracking and bit 10 failure.

Figure 1:
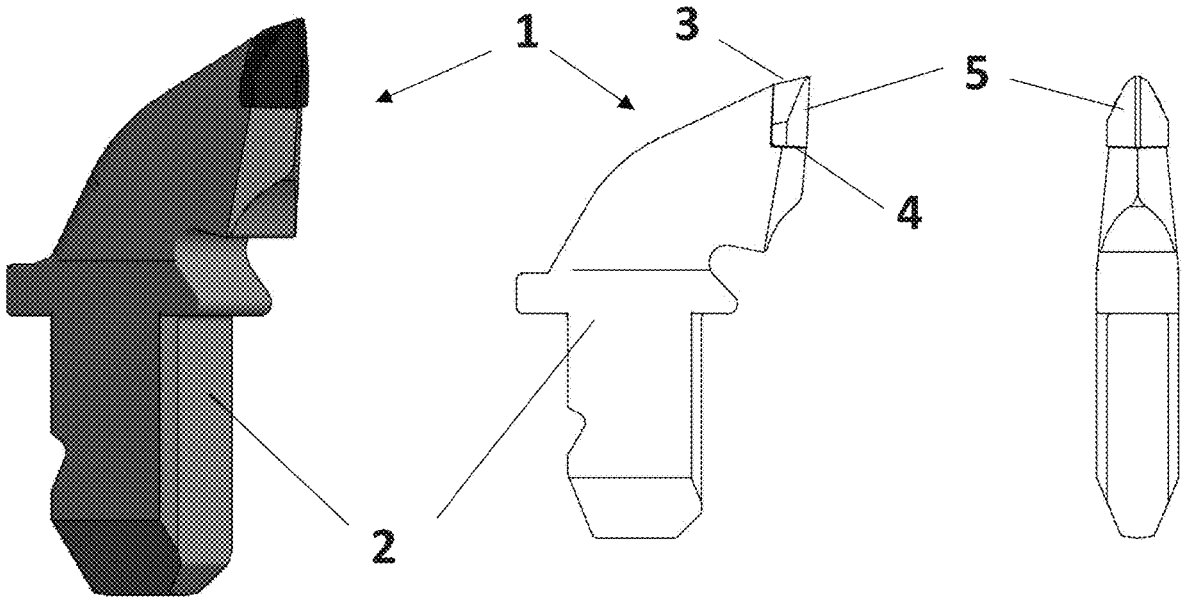
PRIOR ART FIG. 1
FIG. 1 shows perspective, side elevation and front elevation views of a prior art bit with a tungsten carbide insert.
Figure 6:
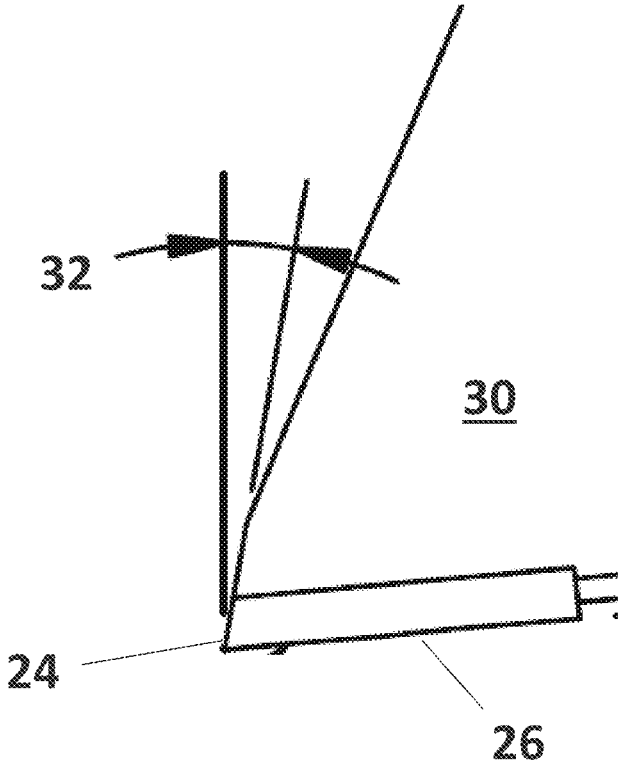
FIG. 6 is a detail side elevation view showing the back cut adjacent the cutting surface.

As can be seen in FIG. 2 and FIG. 3, the hardened cutting surface 24 is provided with a flat cutting profile 26 which is generally parallel to the ore-facing surface of the ore face engagement portion 30. Unlike the undesirable cutting mechanism of the prior art shown in FIG. 1 which generates a fracturing action, the cutting surface 24 and the cutting profile 26 provide a shearing mechanism for extraction which in many ore types would be desirable. The ore face engagement portion 30 is also provided with a dual angle back cut 32 adjacent the ore-facing surface and the hardened cutting surface 24, as is best seen in FIG. 6, a 10 degree angle which is independent of the as-forged angle it mates to at the forged body. This 10 degree angle provides a combination of robust structure to support the cutting face, with enough of a relief angle to allow the cut material to escape in behind.

To manufacture the bit 10, the first step is to provide steel of suitable composition for forging into a body 12. Once forged into the desired shape, the body 12 is through hardened to 46-48 RC as noted above, although those skilled in the art would appreciate that this range may be modified as appropriate in different settings or using different materials. The body 12 is then subjected to shot blasting followed by cleaning. The cleaned body 12 is then ready for application of the hard surfacing material. Once the hard surfacing materials is applied, it is ground to form a desired rough profile surfacing, and subsequently this profiled surfacing is sharpened to provide the final cutting surface. The forming and sharpening may be undertaken using a Yaskawa™ robotic cell utilizing a ceramic grinding wheel for material removal, but those skilled in the art will be able to identify other equipment suitable for achieving the desired result.

While it is believed that bits manufactured according to the present invention would manifest significant useful life and reduce cracking and other early failure events, it is understood that in time even these bits would need to be replaced or repaired. Bits according to the present invention can be more easily and inexpensively rebuilt or repaired than certain prior art bits. Where some of the hardened cutting surface 24 has worn away through repeated use over time, or even where some of the underlying ore face engagement portion 30 has worn away, rebuilding can be attempted by a skilled person. Where some of the ore face engagement portion 30 has worn away, material can be added to the ore face engagement portion 30 to restore gage length, for example through a plasma transfer arc process. Once the newly rebuilt portion 30 has been formed and shaped into the necessary ore-facing surface profile, new hard surfacing material—preferably as described above—can be applied and profiled into a new profiled surfacing, followed by sharpening on the profiled surfacing to generate a hardened cutting surface 24 similar to the original.

The foregoing is considered as illustrative only of the principles of the present invention. The scope of the claims should not be limited by the exemplary embodiments set forth in the foregoing, but should be given the broadest interpretation consistent with the specification as a whole.

The invention claimed is:

1. A replaceable bit for use in radial mining equipment, the bit comprising:

a body, the body comprising a retention portion and an ore face engagement portion, the ore face engagement portion having an ore-facing surface and an as-forged forward angle, the ore face engagement portion further provided with a flat back cut angle independent of the as-forged forward angle; and a non-embedded cutting surface applied on the ore-facing surface;

wherein the cutting surface is composed of shaped and sharpened hard surfacing oriented along the flat back cut angle at a forward edge thereof.

2. The replaceable bit of claim 1 wherein the body is composed of AISI 4140 steel.

3. The replaceable bit of claim 1 wherein the ore face engagement portion comprises an integral removal notch.

4. The replaceable bit of claim 1 wherein the retention portion comprises an integral retention notch.

5. The replaceable bit of claim 1 wherein the hard surfacing is composed of a powdered compound with a nickel base applied to the ore-facing surface.

6. The replaceable bit of claim 1 wherein the hard surfacing is provided with a flat cutting profile generally parallel to the ore-facing surface.

7. The replaceable bit of claim 1 wherein the body and the hard surfacing are composed of materials having equivalent thermal expansion rates.

8. The replaceable bit of claim 1 wherein the hard surfacing is of a uniform thickness in the range of 0.03 inches to 0.1 inches.

9. The replaceable bit of claim 8 wherein the hard surfacing is of a uniform thickness of 0.0625 inches.

* * * * *